US010634004B2

(12) United States Patent
Giljohann et al.

(10) Patent No.: US 10,634,004 B2
(45) Date of Patent: Apr. 28, 2020

(54) DEVICE AND METHOD FOR CLEANING THE CORE ENGINE OF A JET ENGINE

(71) Applicant: LUFTHANSA TECHNIK AG, Hamburg (DE)

(72) Inventors: Sebastian Giljohann, Darmstadt (DE); Daniel Gobel, Seligenstadt (DE); Michael Mensch, Stockstadt (DE); Joachim Heine, Bad Nauheim (DE); Joachim Hacker, Wachtersbach (DE)

(73) Assignee: Lufthansa Technik AG, Hamburg (DE)

( * ) Notice: Subject to any disclaimer, the term of this patent is extended or adjusted under 35 U.S.C. 154(b) by 382 days.

(21) Appl. No.: 15/218,669

(22) Filed: Jul. 25, 2016

(65) Prior Publication Data

US 2016/0333732 A1 Nov. 17, 2016

Related U.S. Application Data

(60) Division of application No. 12/769,514, filed on Apr. 28, 2010, which is a continuation of application No. (Continued)

(30) Foreign Application Priority Data

Mar. 16, 2007 (EP) ..... 07005446

(51) Int. Cl.
*B08B 3/02* (2006.01)
*B08B 3/10* (2006.01)
(Continued)

(52) U.S. Cl.
CPC ..... *F01D 25/002* (2013.01); *B08B 3/02* (2013.01); *B08B 3/10* (2013.01); *B08B 9/0321* (2013.01); *F05D 2220/32* (2013.01)

(58) Field of Classification Search
CPC ..... B08B 3/02; B08B 9/0321; B08B 3/10; F05D 2220/32; F01D 25/002
See application file for complete search history.

(56) References Cited

U.S. PATENT DOCUMENTS 2,689,456 A 9/1954 White
3,033,711 A 5/1962 Harding
(Continued)

FOREIGN PATENT DOCUMENTS

EP 1 205 640 5/2002
EP 1 255 307 7/2002
(Continued)

OTHER PUBLICATIONS

Asplund, Peter, U.S. Office Action dated Nov. 3, 2010, directed to U.S. Appl. No. 12/464,580; 12 pages.
(Continued)

*Primary Examiner* — Alexander Markoff
(74) *Attorney, Agent, or Firm* — BakerHostetler

(57) ABSTRACT

A device for cleaning the core engine of a jet engine includes a supply unit, which provides the cleaning medium, a nozzle unit, which is configured for feeding the cleaning medium into the core engine, and a line connection between the supply unit and the nozzle unit. The nozzle unit includes a means for the rotationally fixed connection to the fan shaft of the jet engine, and that a rotary coupling is provided between the nozzle unit and the line connection. The device may be arranged with a turbo fan jet engine. A method for cleaning, the core engine of a jet engine uses the device.

35 Claims, 6 Drawing Sheets

Related U.S. Application Data

12/302,682, filed as application No. PCT/EP2008/001983 on Mar. 12, 2008, now Pat. No. 8,216,392.

(51) Int. Cl.
*B08B 9/032* (2006.01)
*F01D 25/00* (2006.01)

(56) References Cited

U.S. PATENT DOCUMENTS

| | | | |
|---|---|---|---|
| 3,623,668 | A | 11/1971 | Fried et al. |
| 4,059,123 | A | 11/1977 | Bartos et al. |
| 4,065,322 | A | 12/1977 | Langford |
| 4,196,020 | A | 4/1980 | Hornak |
| 4,834,912 | A | 5/1989 | Hodgens, II et al. |
| 5,011,540 | A | 4/1991 | McDermott |
| 5,273,395 | A | 12/1993 | McDermott |
| 5,868,860 | A | 2/1999 | Asplund |
| 6,073,637 | A | 6/2000 | Hayward |
| 6,470,668 | B2 | 10/2002 | Payling et al. |
| 6,478,033 | B1 | 11/2002 | Foster |
| 6,491,048 | B1 | 12/2002 | Foster |
| 6,503,334 | B2 | 1/2003 | Ruiz et al. |
| 6,553,768 | B1 | 4/2003 | Trewin et al. |
| 6,630,198 | B2 | 10/2003 | Ackerman |
| 6,932,093 | B2 | 8/2005 | Ogden et al. |
| 7,198,052 | B2 | 4/2007 | Watt |
| 7,252,095 | B2 | 8/2007 | Watt |
| 7,297,260 | B2 | 11/2007 | Hjerpe et al. |
| 7,445,677 | B1 | 11/2008 | Asplund |
| 7,497,220 | B2 | 3/2009 | Asplund |
| 2002/0124874 | A1 | 9/2002 | Butler |
| 2002/0129837 | A1 | 9/2002 | Ruiz et al. |
| 2003/0209256 | A1 | 11/2003 | Tadayon |
| 2004/0016445 | A1 | 1/2004 | Koch et al. |
| 2004/0028816 | A1 | 2/2004 | Ackerman et al. |
| 2004/0055626 | A1 | 3/2004 | Hata |
| 2005/0199270 | A1 | 9/2005 | Watt |
| 2006/0048796 | A1 | 3/2006 | Asplund et al. |
| 2006/0219269 | A1 | 10/2006 | Rice et al. |
| 2006/0243308 | A1 | 11/2006 | Asplund et al. |
| 2007/0000528 | A1 | 1/2007 | Asplund et al. |
| 2007/0028947 | A1 | 2/2007 | Erikson |
| 2008/0040872 | A1 | 2/2008 | Hjerpe |
| 2008/0078422 | A1 | 4/2008 | Wagner |
| 2008/0087301 | A1 | 4/2008 | Lee et al. |
| 2008/0149141 | A1 | 6/2008 | Sales |
| 2010/0200023 | A1 | 8/2010 | Giljohann et al. |

FOREIGN PATENT DOCUMENTS

| | | |
|---|---|---|
| EP | 1 970 133 A1 | 9/2008 |
| JP | 55054672 | 4/1980 |
| JP | 2000240470 | 9/2000 |
| SE | 522306 | 1/2004 |
| WO | 92/14557 | 9/1992 |
| WO | 96/40453 | 12/1996 |
| WO | 2005/077554 | 8/2005 |
| WO | 2005/120953 | 12/2005 |
| WO | 2008/113501 A1 | 9/2008 |

OTHER PUBLICATIONS

International Search Report dated May 6, 2008, directed to International Application No. PCT/EP2008/001983.
Blum, Andrew; "Sure, a Jet's Wings Need Scrubbing, But Its Guts Need a Flush, Too", Wired Magazine, Issue 16:01; Dec. 20, 2007.
Lufthansa Technik Connection Jul. 4, 2007/Aug.; 20 pages.
Accelerated Examination Support Document filed in U.S. Appl. No. 12/124,199, dated May 21, 2008 (now U.S. Pat. No. 7,445,677); 20 pages.
International Preliminary Report on Patentability dated Oct. 6, 2009, directed to International Application No. PCT/ EP2008/001983; 7 pages.
U.S. Office Action dated Jul. 22, 2010, in U.S. Appl. No. 12/769,514.
U.S. Office Action dated Sep. 22, 2010, in U.S. Appl. No. 12/769,514.
U.S. Office Action dated Dec. 29, 2010, in U.S. Appl. No. 12/769,514.
U.S. Office Action dated Feb. 21, 2012, in U.S. Appl. No. 12/769,514.
Accelerated Examination Support Document filed in U.S. Appl. No. 12/769,514, dated Apr. 28, 2010; 48 pages.
Pre-Examination Search Document filed in U.S. Appl. No. 12/769,514 dated Apr. 28, 2010; 6 pages
Translation of the priority document EP 07005446.
U.S. Office Action dated Jun. 10, 2011, in U.S. Appl. No. 12/302,682.
U.S. Office Action dated Jan. 6, 2012, in U.S. Appl. No. 12/302,682.
U.S. Notice of Allowance dated May 7, 2012, in U.S. Appl. No. 12/302,682.

DEVICE AND METHOD FOR CLEANING THE CORE ENGINE OF A JET ENGINE

REFERENCE TO RELATED APPLICATIONS

This application is a division of U.S. Ser. No. 12/769,514, filed Apr. 28, 2010, which is a continuation of U.S. Ser. No. 12/302,682, filed Nov. 26, 2008, now U.S. Pat. No. 8,216,392, which is the national stage under 35 USC 371 of International Application No. PCT/EP2008/001983, filed Mar. 12, 2008, which claims the priority of European Application No. 07005446.5, filed Mar. 16, 2007. The entire contents of these four prior applications are incorporated herein by reference.

FIELD OF THE INVENTION

The invention relates to a device, to an arrangement and also to a method for cleaning the core engine of a jet power plant.

BACKGROUND OF THE INVENTION

Jet power plants of commercial subsonic transport aircraft are today widely predominantly so-called turbofan jet power plants. Such a turbofan power plant has a so-called core engine in which the actual combustion process of the kerosene is carried out. The core engine in a known manner has one or more compressor stages, a combustion chamber, and also one or more turbine stages in which the hot combustion gases yield some of their mechanical energy. This mechanical energy for one thing is required for driving the compressor stages, and for another thing a so-called turbofan, which is arranged upstream, is driven by the core engine and as rule has a significantly larger diameter than the core engine, and allows a considerable part of the air which flows through the power plant as a whole to bypass the core engine as so-called bypass airflow or secondary airflow. The turbofan makes up a significant part of the thrust power of the power plant via this bypass airflow, and in addition the high bypass airflow portion provides for a better environmental compatibility of the power plant, especially a better efficiency at subsonic speeds, and also an improved noise suppression of the hot exhaust gas flow of the core engine.

Jet power plants, during operation, are contaminated as a result of combustion residues of the core engine, and also as a result of air contaminants which are drawn in with the combustion or bypass air, such as dust, insects, saline fog, or other environmental contaminants. These contaminants especially also form a coating on the rotor blades and/or stator blades of the compressor of the core engine, which impairs the surface quality and, as a result, ultimately the thermodynamic efficiency of the power plant.

For removing the contaminants, jet power plants are cleaned. It is known from WO 2005/077554 A1 to arrange a multiplicity of cleaning nozzles upstream of the fan of a turbofan power plant for this purpose in order to thus clean the fan and the core engine.

SUMMARY OF THE INVENTION

The invention is based on the object of creating a device, a method and an arrangement of the type mentioned in the introduction, which enable an effective and efficient cleaning of the core engine of a jet power plant.

The device according to the invention has a supply unit which provides cleaning medium, a nozzle unit which is designed for introducing the cleaning medium into the core engine, and also a line connection between the supply unit and the nozzle unit. According to the invention, it is provided that the nozzle unit has means for the rotationally fixed connection to the shaft of the fan of the jet power plant, and that a rotary joint is provided between the nozzle unit and the line connection.

First of all, some terms which are used within the scope of the invention are to be explained. The term jet power plant refers to mobile gas turbines of any kind for aviation applications. Within the scope of the invention, the term refers particularly to turbofan power plants, in which the actual gas turbine forms a so-called core engine, and a turbofan of larger diameter is arranged upstream of the core engine and creates a bypass airflow around the core engine. The term core engine refers to the actual gas turbine of the jet power plant, in which gas turbine the combustion process of the fuel, especially kerosene, takes place. Such a core engine as a rule has one or more compressor stages, a combustion chamber, and also one or more turbine stages which are driven by the hot combustion gases.

The supply unit provides cleaning medium (for example in one or more tanks) and can be provided with operating units and drive units, pumps, energy accumulators or the like. It is preferably designed as a mobile, especially portable unit.

The nozzle unit has one or more nozzles for the cleaning medium, and also means which are explained in more detail below for the rotationally fixed connection of this nozzle unit, and consequently of the nozzles, to the shaft of the fan of the jet power plant.

According to the invention, it is therefore provided that these nozzles are not arranged in a stationary manner in the region of the inlet of the jet power plant, but are connected in a rotationally fixed manner to the shaft of the fan and therefore during a slow rotation of the power plant can co-rotate with the fan without injecting kerosene (the so-called dry-cranking).

The supply unit and the nozzle unit are interconnected via a line connection. This line connection especially serves for feed (preferably under pressure and possibly heated) of the cleaning medium to the nozzles of the nozzle unit. The line connection is preferably flexible and can especially have a possibly pressure-tight hose.

The line connection is connected to the nozzle unit by means of a rotary joint. The term rotary joint is to be functionally understood and refers to a device of any kind which is suitable for creating a sufficiently stable, preferably pressure-tight and fluid-tight connection between the stationary part of the line connection and the nozzle unit which co-rotates with the fan. It is the purpose of the rotary joint to direct the cleaning medium from the stationary supply unit to the co-rotating nozzle unit and then to allow the cleaning fluid to discharge from the nozzles.

The invention enables a purposeful cleaning of the core engine. The nozzles which co-rotate during the dry-cranking sweep over the intake of the core engine uniformly over the entire circumference. Furthermore, the co-rotating arrangement of the nozzles allows a purposeful introduction of the cleaning medium in the flow direction behind the blades of the fan and therefore allows a direct sweeping of the core engine without impairment by the turbofan which is arranged upstream of it in the flow direction. In the case of the stationary arrangement of the nozzles upstream of the fan in the prior art, an essential part of the cleaning medium impinges upon the blades of the fan and therefore is not able to contribute, or at least not directly contribute, to the cleaning of the core engine. The invention has recognized that the purposeful cleaning of the core engine is essential for the aimed-for improvement of the thermodynamic efficiency. The invention has furthermore recognized that a possibly desired additional cleaning of the fan wheel can be achieved in an essentially simpler manner by means of an additional manual cleaning with hose and brush. A sweeping-over also of the fan blades, as provided in the prior art, is not able to remove a significant part of the contaminants of the fan blades since this accumulatively sits on the rear side (pressure side) of the fan blades. Furthermore, in the case of a simultaneous sweeping-over of the fan blades with cleaning medium, dirt which is removed there, and also especially lubricant which has been washed off in the region of the blade root, are carried into the core engine and additionally contaminate this.

The mass distribution of the nozzle unit is preferably axially symmetrical around its rotational axis. In this way, during co-rotation of the nozzle unit no significant additional out-of-balance is introduced. For this purpose, the rotary joint is seated preferably essentially centrally on the rotational axis of the device according to the invention in the installed state. The nozzle unit preferably has at least two or more nozzles which are preferably distributed in an axially symmetrical manner around the rotational axis.

The discharge opening of the nozzles is preferably arranged in the axial end section of the nozzle unit which points away from the rotary joint. The rotary joint is preferably located in the front section of the nozzle unit, i.e. in that section which in the installed state points upstream, that is to say points away from the intake of the jet power plant. The discharge opening of the nozzles is correspondingly provided in the axial end section of the nozzle unit which points away from it, that is to say in the end section which points downstream in the installed state. This arrangement enables the nozzles to be fitted either through the interspaces of the fan blades during installation on the shaft of the fan of a turbofan power plant, so that they are arranged directly upstream of the core engine, or else are to be oriented in an at least purposeful manner so that they direct jets through interspaces of the fan blades directly onto the core engine.

The nozzles are preferably flat jet nozzles, but other shapes such as round jet nozzles or a combination of different nozzles can be also be used. The jet plane is preferably oriented in the radial direction, i.e. it is spanned by two axes, of which one points in the radial direction. In this way, the rotating flat jet can sweep over essentially the entire area of the intake of the core engine in an especially effective manner.

It is additionally preferred that the jet plane with the rotational axis includes an incident angle. This means that the jet direction does not occur parallel to the rotational axis but with this axis includes an angle. The jet direction deviates by this angle from the axial direction. It is preferred if this angle follows the incident angle of the front compressor blades of the core engine. As a rule, in this case it concerns stator blades which with a suitable adaptation of the jet angle to their set angle can be partially impacted by the flat jet so that a more effective cleaning occurs of the parts of the core engine which are arranged behind them.

The means for the rotationally fixed connection to the shaft of the fan of the jet power plant preferably comprises fastening means for the fastening on the fan blades, such as suitably designed hooks with which the nozzle unit can be hooked on the trailing edge (facing downstream) of the fan blades.

For the rotationally fixed fixing to the shaft of the fan, the nozzle unit can have a device for the essentially form-fitting seating on the shaft hub of the fan.

Turbofan power plants on the upstream shaft end of the shaft of the turbofan as a rule have a conically curved hub which is to improve the inflow behavior of the air. The corresponding means for the rotationally fixed connected are seated on this hub. 'In an essentially form-fitting manner' in this connection means that the shape of the shaft hub is used for the intended positioning of the nozzle unit and for fixing in the desired position. It does not mean that the entire surface of the shaft hub has to be encompassed in a form-fitting manner.

For example, the device can have one or more ring components with which it can be seated on the shaft hub. In the case of a multiplicity of ring components these have a different diameter which is adapted to the diameter of the shaft hub in the corresponding regions. For example, two axially spaced apart rings of different diameter can be provided, with which the nozzle unit is positioned and centered on the shaft hub.

The material of the device for the essentially form-fitting seating on the shaft hub of the fan is preferably selected so that no wear, or only insignificant wear, of this shaft hub occurs as a result of a possible friction on the shaft hub. For example, this unit can have an adequately soft plastic or rubber coating or covering.

Tensioning cables can preferably be provided for the further fixing. For example, the nozzle unit can be centered on the shaft hub of the fan by means of the ring components and then braced with tensioning cables which are fixed on the trailing edge of the fan blades. According to the invention, spring units for pretensioning the tensioning cables can be provided so that the nozzle unit is pressed onto the shaft hub with a defined force.

The tensioning cables are preferably fastened (for example by means of hooks or clamping claws) on the fan blades, preferably on their trailing edge. These hooks or clamping claws can also have an adequately soft plastic or rubber coating or covering.

The supply unit for the cleaning medium preferably has at least one storage tank for cleaning medium and at least one pump for pressurizing the nozzle unit with cleaning medium. The storage tank can have a heater unit in order to provide a temperature-regulated cleaning medium. In a preferred embodiment, the supply unit has at least two storage tanks from which the nozzle unit can be selectively supplied. This has the advantage that after a cleaning process cleaning medium which is freshly replenished in a cleaning tank can be heated up to the desired temperature, while a further cleaning process is supplied at the same time from the second cleaning tank.

A liquid, especially an aqueous liquid or a dispersion of a liquid in a gaseous medium, especially air, can preferably be used as cleaning medium. An aqueous solution is preferably used, which when discharging from the nozzles is atomized to form an aqueous dispersion in air. Further details of this are described below in conjunction with the explanation of the method according to the invention. The method parameters which are described there also apply to the device according to the invention. It is therefore the subject of the invention to design the device so that the method parameters which are further described below can be established.

The subject of the invention is also an arrangement consisting of a jet power plant and a device which is attached to the power plant for undertaking a cleaning of the core engine, as previously described. The arrangement furthermore has the following features:

a. The nozzle unit is connected in a rotationally fixed manner to the shaft of the fan of the jet power plant;
b. The rotational axes of the fan of the jet power plant and of the nozzle unit are arranged essentially concentrically;
c. The nozzles of the nozzle unit have a radial distance from the common rotational axis of the jet power plant and of the device, which is less than the radius of the intake opening of the core engine;
d. The discharge openings of the nozzles are arranged in the axial direction behind the plane of the fan, and/or the nozzles are arranged in interspaces of the fan blades or oriented towards interspaces of the fan blades so that the nozzle jets can pass through the plane of the fan essentially unhindered.

In the case of the arrangement according to the invention, the nozzle unit is connected in a rotationally fixed manner to the shaft of the fan of the jet power plant. In this case, the rotational axes of the fan of the jet power plant and of the nozzle unit are arranged essentially concentrically. The rotational axis of the nozzle unit is that axis around which the nozzles concentrically rotate during operation. The radial distance of the nozzles of the nozzle unit from the common rotational axis of the jet power plant and of the device is dimensioned so that these nozzles sweep over the intake of the core engine. The discharge openings of the nozzles are oriented behind the plane of the turbofan, or in front of or between the fan blades so that an essentially unhindered jet penetration is possible.

The incident angle of the jet plane of the nozzles with the rotational axis is preferably adapted to the incident angle of the front blades of the core engine in the flow direction of the power plant. In this way, the cleaning action is also improved in the rear section of the core engine.

A method for cleaning the core engine of a jet power plant using a device as previously described is also the subject of the invention. The steps of the method according to the invention are:

a. Attaching the nozzle unit to the hub of the fan so that the discharge openings of the nozzles are oriented towards the front blades of the core engine in the flow direction of the power plant;
b. Allowing the jet power plant to rotate;
c. Pressurizing the nozzle unit with cleaning medium and cleaning the core engine.

The dry-cranking, or allowing the jet power plant to rotate during the cleaning process, is preferably carried out with a speed of 50 to 500 rpm, preferably 100 to 300 rpm, more preferably 120 to 250 rpm. A speed between 150 and 250 rpm is particularly preferred. The cleaning can also take place during idling of the power plant, the speed then preferably being 500 to 1,500 rpm.

A dispersion of a liquid in a gaseous medium is preferably used as cleaning medium. This dispersion can already be produced upstream of the nozzle discharge opening, for example by the addition of gaseous medium, such as air, to a cleaning liquid. However, it is preferred if only liquid cleaning medium is directed to the nozzle discharge opening and atomized at the nozzle discharge opening by discharging at high pressure so that there the mixture consists of liquid and gaseous medium. This dispersion or this aerosol is then carried through the core engine. The cleaning medium (or the liquid portion of the aerosol) is preferably temperature-regulated to a range of 20 to 100° C., more preferably 30 to 80° C., more preferably 50 to 70° C. The pressure under which the cleaning medium is discharged at the nozzle opening preferably lies within the range of 20 to 100 bar, more preferably 30 to 80 bar, more preferably 50 to 70 bar. As a result of this pressure the liquid cleaning medium at the nozzle opening is preferably broken down into droplets, of which the average droplet size is 50 to 500 μm, more preferably 100 to 300 μm, more preferably 150 to 250 μm.

The throughput of liquid cleaning medium preferably lies between 10 and 200 l/min, more preferably 20 to 150 l/min, more preferably 20 to 100 l/min, especially preferably between 20 and 60 l/min. The duration of the cleaning process is preferably 1 to 15 min, more preferably 2 to 10 min, more preferably 3 to 7 min.

The tank, or each tank, for cleaning medium of the supply unit for example can have a volume of 400 l. This volume allows for example a 5 min. cleaning with a throughput of 80 l/min.

BRIEF DESCRIPTION OF THE DRAWINGS

An exemplary embodiment of the invention is explained in the following with reference to the drawings. In the drawing.

DETAILED DESCRIPTION OF THE INVENTION

Figure 1:
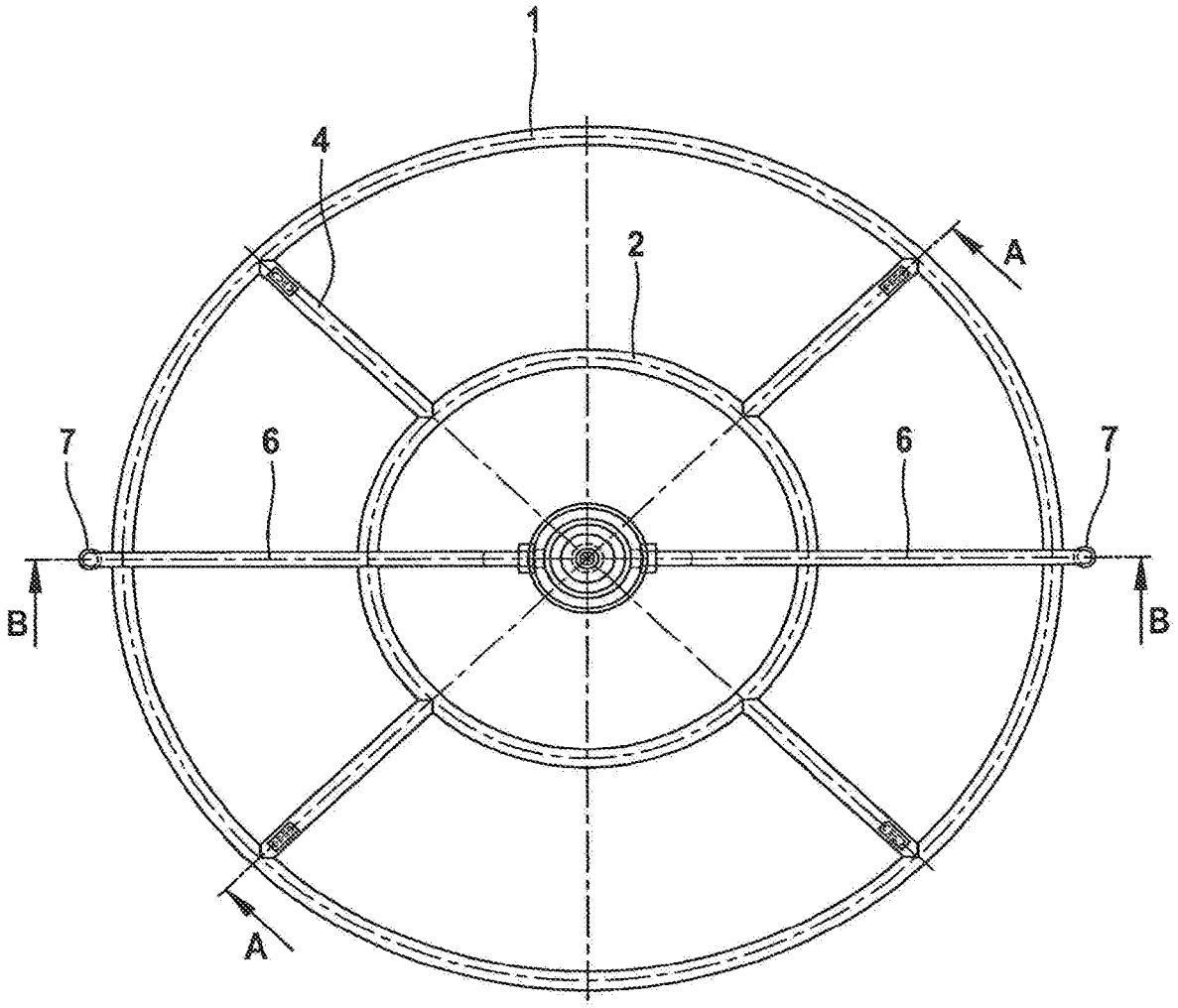
FIG. 1 shows a view of a nozzle unit according to the invention from the front.
Figure 2:
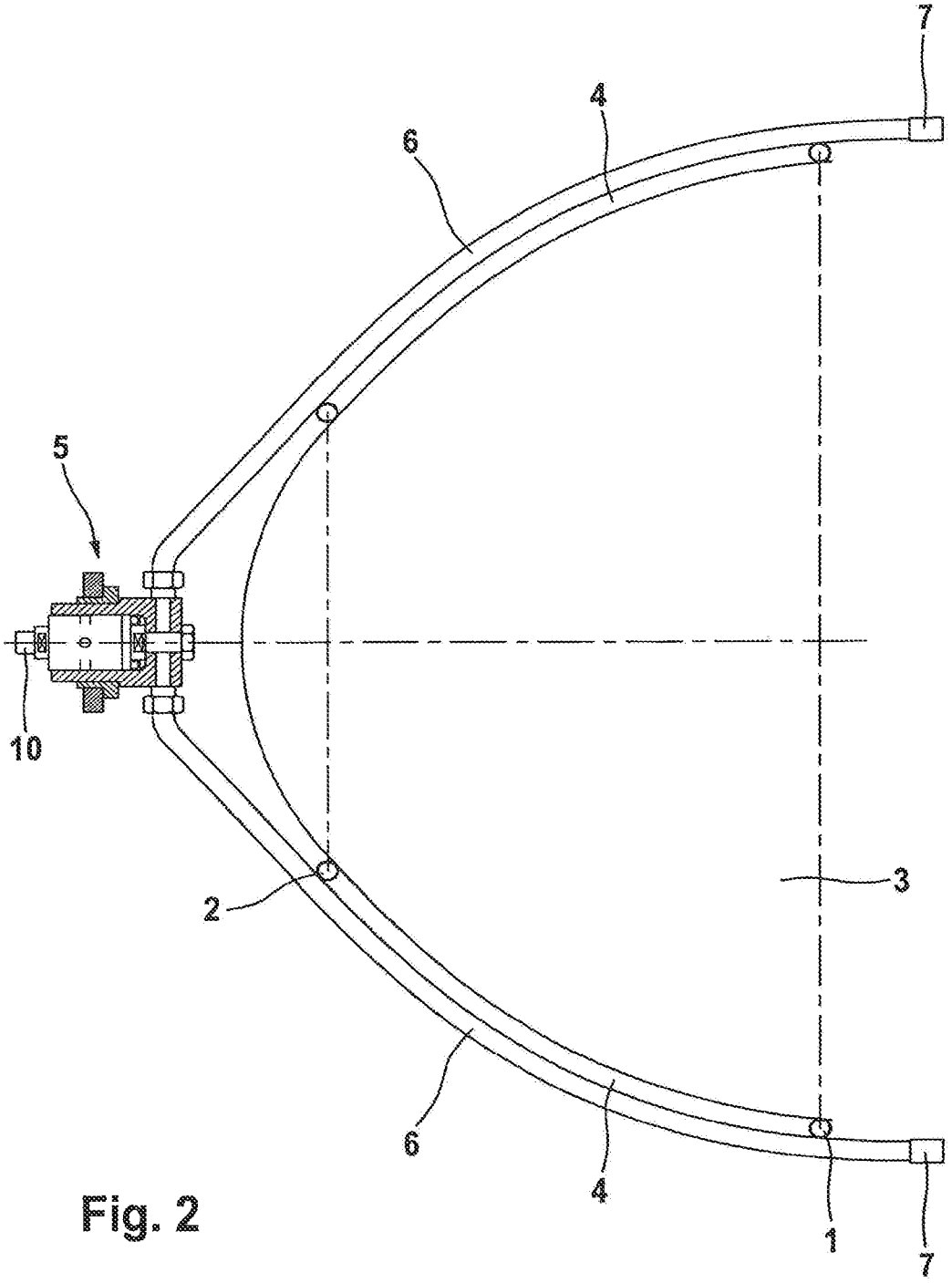
FIG. 2 shows a section through the plane B-B of FIG. 1 of a nozzle unit which is seated on the shaft hub of a fan.
Figure 3:
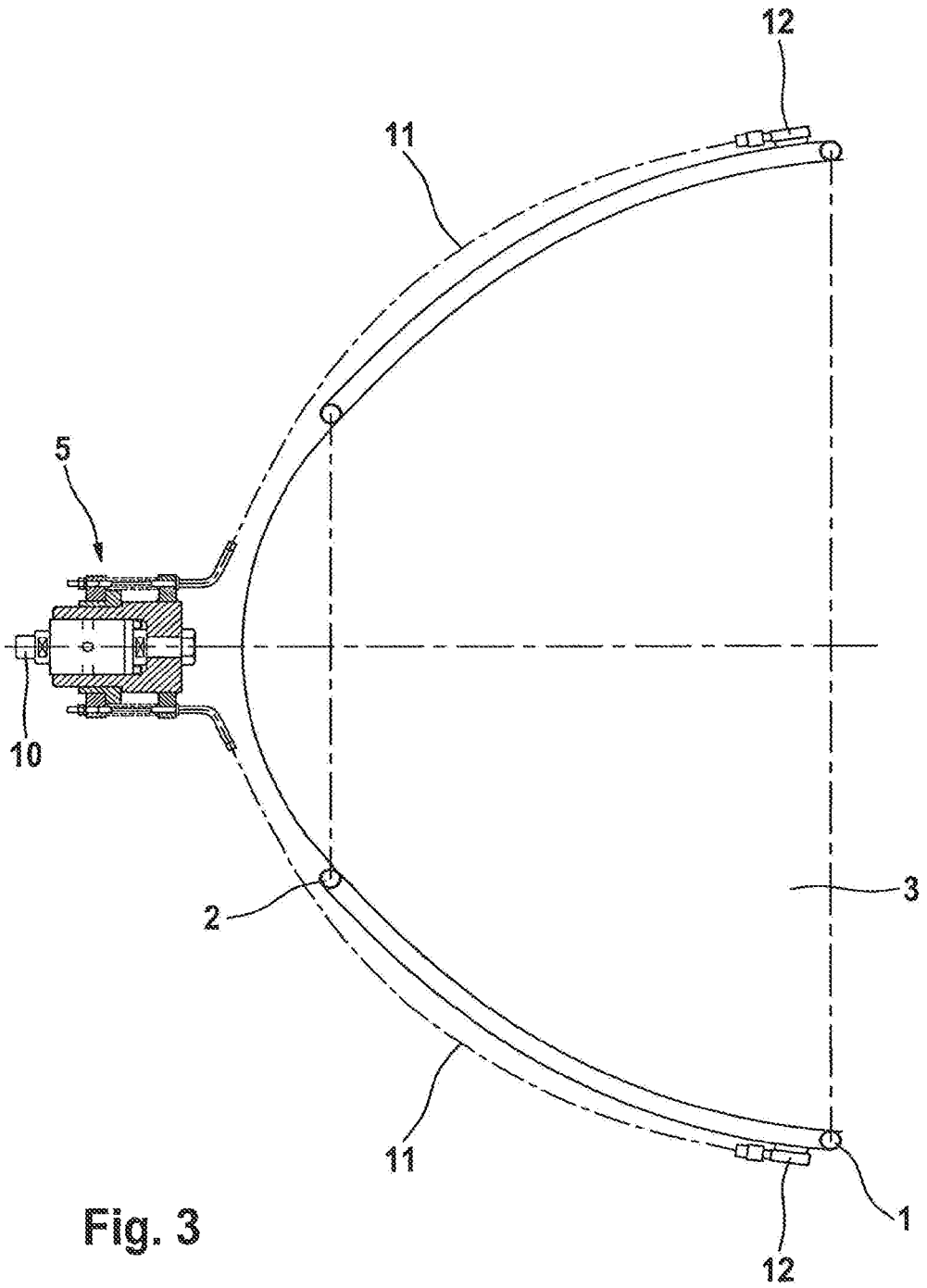
FIG. 3 shows a section through the plane B-A of FIG. 1 of a nozzle unit which is seated on the shaft hub of a fan.
Figure 4:
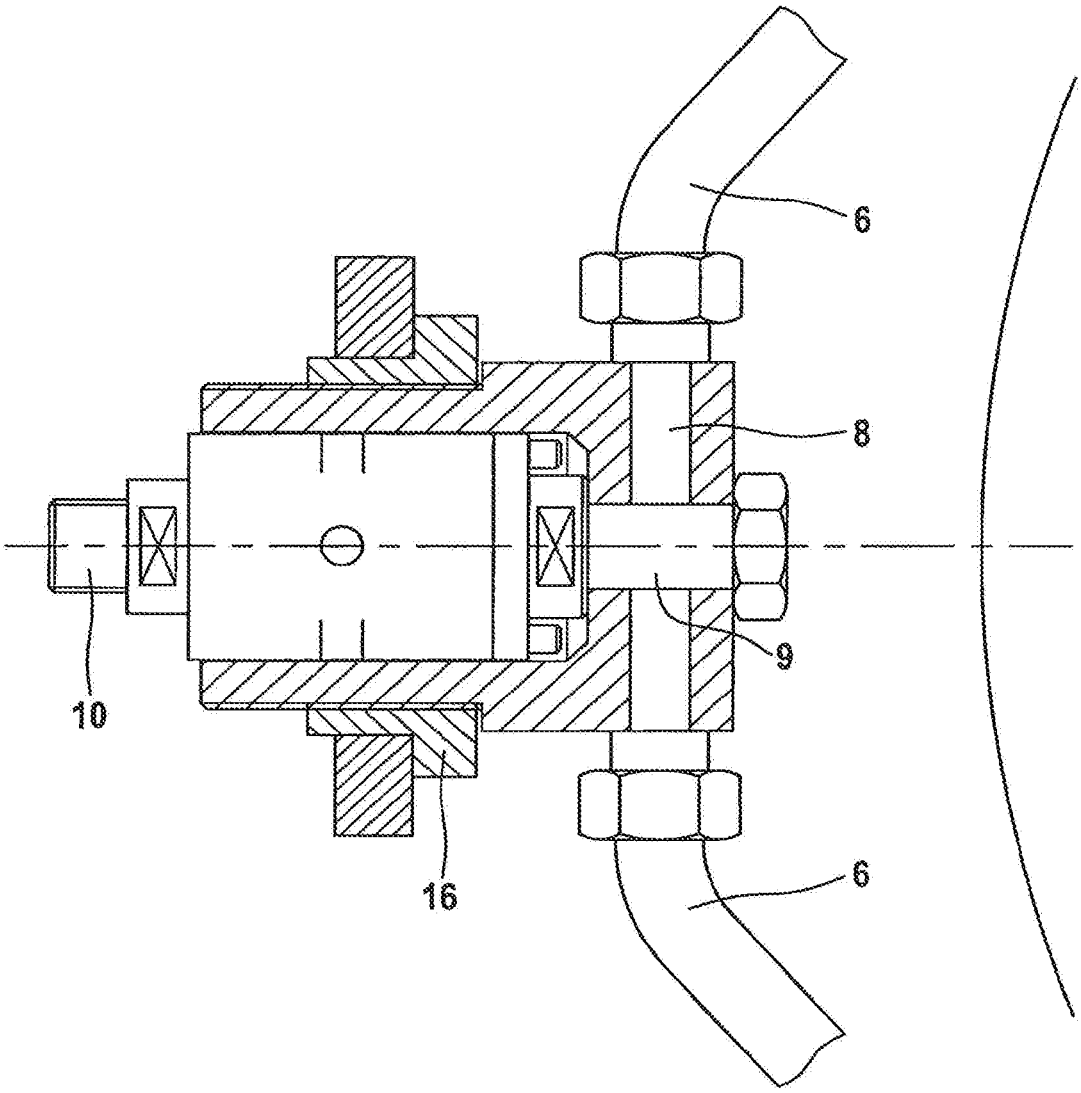
FIG. 4 shows in a detail from FIG. 2 the rotary joint.

The nozzle unit has two ring elements 1, 2 by means of which the nozzle unit is seated on a shaft hub 3 of the fan of a jet power plant (see FIGS. 2 and 3). In the seated state the ring elements 1, 2 encompass the shaft hub 3 in an essentially form-fitting manner. The two ring elements 1, 2 are interconnected by means of radial struts 4. A rotary joint, which as a whole is designated 5, is arranged on the point of the nozzle unit which points upstream (with regard to the flow direction of the power plant). From this rotary joint extend two radially outwardly leading pressure lines 6 which supply two flat jet nozzles 7 with cleaning medium. In the detailed view of FIG. 4 it is to be seen that the two pressure lines 6, via radial passages 8 and an axial passage 9 of the rotary joint 5, are in fluid communication with a feed line 10 which connects the rotary joint to the supply unit which is not shown in the drawing.

The pressure lines 6 are fixed at the crossover points with the ring elements 1, 2 to these ring elements and are therefore part of the supporting structure of the entire nozzle unit.

Figure 5:
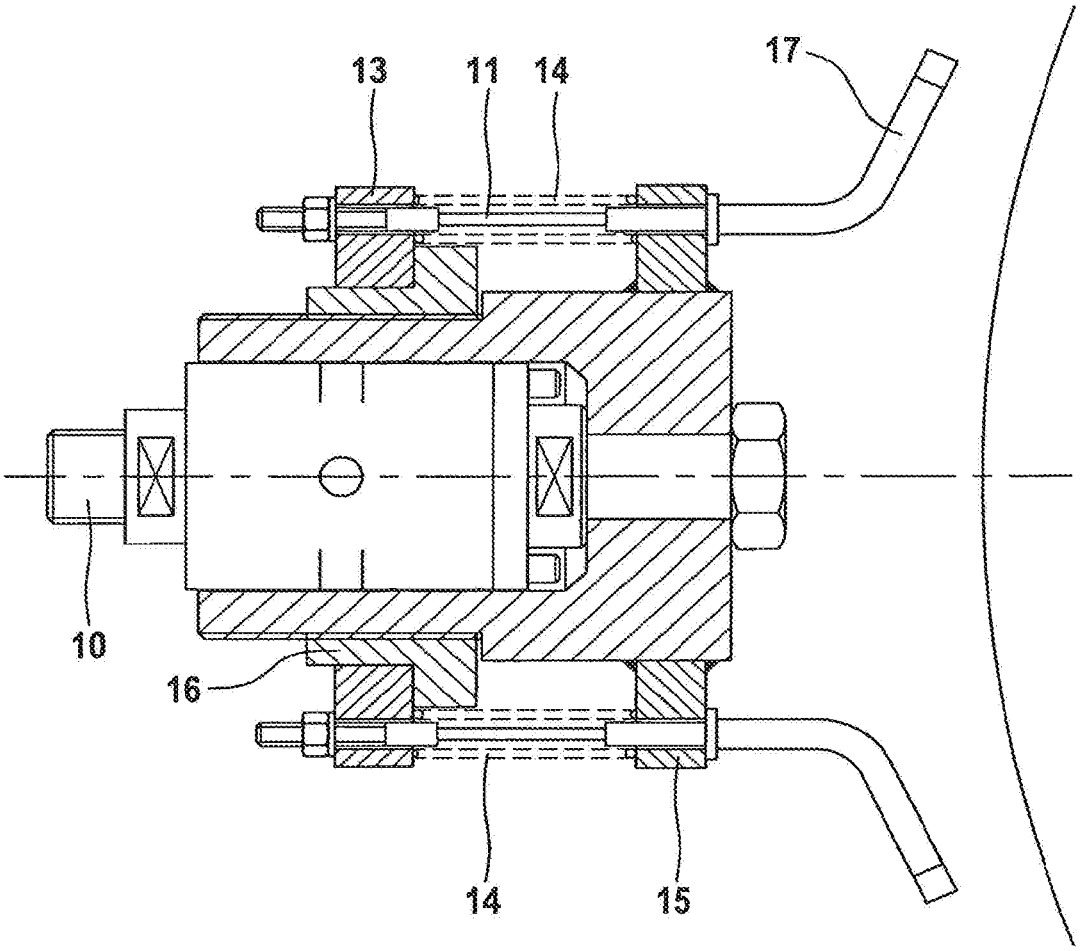
FIG. 5 shows in a detail from FIG. 3 the rotary joint.

For fastening the nozzle unit on the shaft hub of the fan, tensioning cables which are indicated by 11, are provided, which by means of hooks 12 are hooked on the trailing edges of the fan blades. As is to be seen in FIG. 5, the tensioning cables 11 are guided to the rotary joint via tensioning cable guides 17 which are fastened on the rotary joint, and are fastened there on an axially movable clamping ring 13. Compression springs 14 are supported on an annular shoulder 15 of the rotary joint and apply a force upon the clamping ring 13 which acts in the direction away from the annular shoulder 15. In the seated state, the compression springs 14 apply a pretensioning to the tensioning cables 11 and therefore ensure a fixing of the nozzle unit to the hub of the fan. By means of a tensioning nut 16 which is fitted on a thread of the joint housing 18 the clamping ring 13 is moved in the upstream direction. As a result, a tensioning force is transmitted to the tensioning cables 11 and therefore creates a secure connection of the nozzle unit to the hub of the fan.

For cleaning the core engine of a turbofan jet power plant, the nozzle unit, in the way which is especially apparent from FIGS. 2 and 3, is seated on the shaft hub of the fan and fixed on the fan blades by means of the hooks 12. The power plant is set in rotation (dry-cranking). Via the connecting lines 10, the rotary joint 5 and the pressure lines 6, the flat jet nozzles 7 are supplied with cleaning medium from the supply unit, which is not shown. This cleaning medium sweeps over the intake of the core engine over its entire circumference and so carries out the cleaning.

Figure 6:
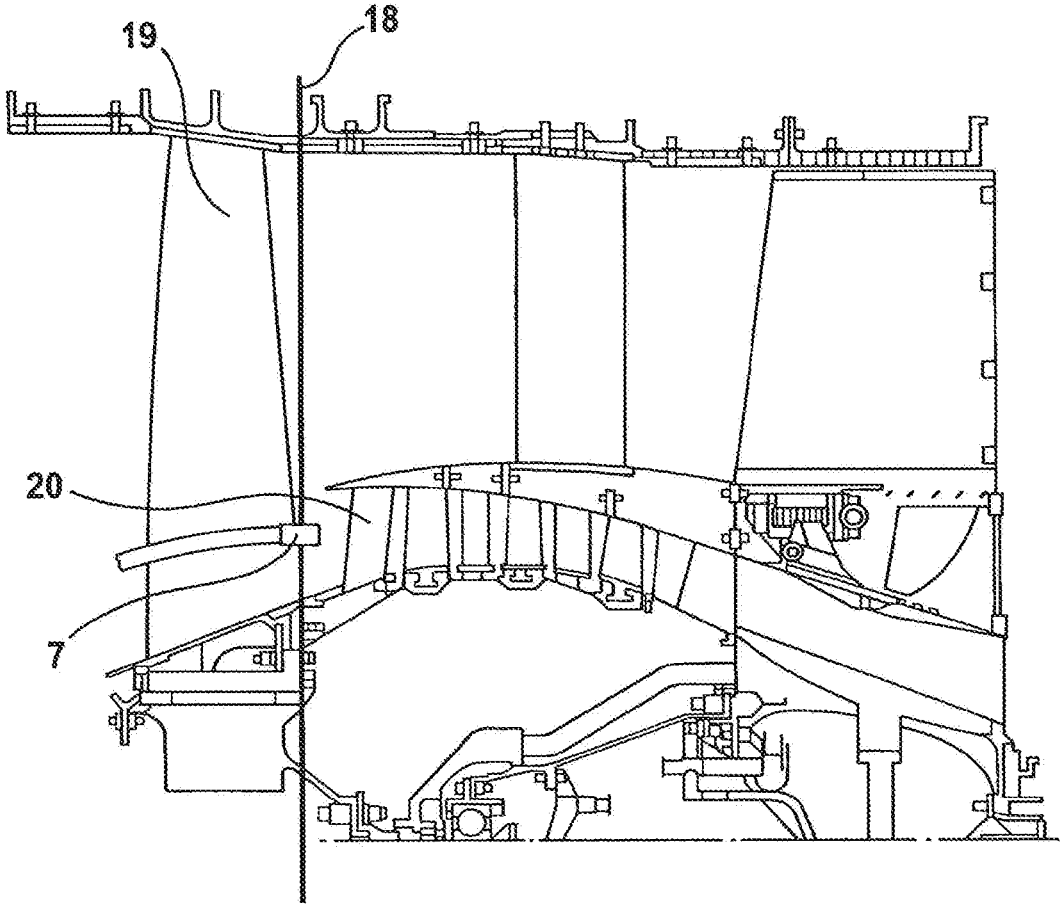
FIG. 6 schematically shows the arrangement of the nozzles behind the plane of the fan blades.

In FIG. 6, it is to be seen that the discharge plane of the nozzles 7 lies in the axial direction of the power plant behind the radial plane, which is indicated by 18, of the turbofan 19. Therefore, a defined and uninterrupted spraying into the core engine 20 is possible. According to the invention, therefore, essentially lower volumes of cleaning medium (especially washing liquid) can be used than in the prior art. As a result of this reduction of liquid volume, the effect is avoided of liquid entering the control lines of the power plant which transmit air pressure from the compressor section to the control unit of the fuel governor. Furthermore, contamination of the engine oil with cleaning liquid is avoided.

According to the invention, these control lines, unlike in the prior art, do not have to be closed or opened before commencement of the power plant washing. A static test of the power plant after a wash and subsequent reconnection of the control lines is therefore not necessary.

The invention claimed is:

1. A method of cleaning a gas turbine engine, said engine including an engine inlet portion having a fan hub and an array of fan blades connected to and extending radially outward from said fan hub, the method comprising:

providing a mobile harness assembly;

positioning and securing the harness assembly directly onto the fan hub;

cranking the gas turbine engine, thereby causing the fan hub to rotate;

supplying washing fluid to the harness assembly; and injecting the washing fluid between fan blades and directly into the gas turbine engine core as the fan hub rotates.

2. The method of claim 1, wherein the mobile harness assembly comprises: a coupling device for connecting one or more fluid supply lines to one or more fluid delivery lines, said coupling device comprising a first portion configured for rotating with the fan hub about the hub's central axis as the engine is cranked and a second portion configured to remain static relative to said first portion;

one or more fluid delivery lines attached at one end to the coupling device's first portion and positioned for delivering washing fluid directly into the gas turbine engine core, said fluid delivery lines rotating with the fan hub about the hub's central axis as the engine is cranked;

one or more fluid supply lines attached at a first end to the coupling device's second portion for supplying washing fluid to the harness assembly, said fluid supply lines remaining in a static position relative to the rotating fluid delivery lines;

one or more harness rings disposed amongst and attached to the one or more fluid delivery lines for spacing, stabilizing, and positioning the fluid delivery lines relative to the fan blades; and a connector for removably attaching the harness assembly onto the fan hub.

3. The method of claim 2, further comprising positioning each of the one or more fluid delivery lines between two fan blades for injecting washing fluid downstream of said fan blades and directly into the gas turbine engine core.

4. The method of claim 2, further comprising:

providing a remote washing fluid source;

connecting the washing fluid source to the one or more fluid supply lines; and supplying washing fluid to the harness assembly through the one or more fluid supply lines.

5. The method of claim 4, further comprising heating the washing fluid prior to injecting said fluid into the gas turbine engine core.

6. The method of claim 2, further comprising a nozzle unit having an essentially form-fitting seating on the hub.

7. The method of claim 2, wherein the connector comprises a connection ring disposed at a base of the harness assembly and attached to one or more of the fluid delivery lines.

8. The method of claim 2, wherein the harness assembly further comprises one or more nozzles connected to a second end of the one or more fluid delivery lines for injecting washing fluid directly into the gas turbine engine core.

9. The method of claim 2, wherein the harness assembly comprises: two fluid delivery lines attached to the rotating first portion of the coupling device, each fluid delivery line being positioned between two fan blades such that the nozzles attached thereto are positioned at a location that is downstream of said fan blades;

one fluid supply line attached to the static second portion of the coupling device;

one harness ring disposed between and connected to the two fluid delivery lines, said harness ring being spaced axially downstream from the coupling device and sized to prevent the coupling device from advancing towards the fan hub; and at least one tensioning cable for temporarily securing the harness assembly to a trailing edge of a fan blade until an engine washing procedure is completed.

10. The method of claim 2, wherein at least one of the harness connector and harness rings are adaptable, the method further comprising sizing the harness assembly according to the size of the fan hub.

11. A method for cleaning a core engine of a jet power plant, using a device comprising a supply unit which provides a cleaning medium; a nozzle unit comprising a rotationally fixed connection to a shaft of a fan of the jet power plant and configured for introducing the cleaning medium into the core engine; a line connection between the supply unit and the nozzle unit; and a rotary joint between the nozzle unit and the line connection, the method comprising:

attaching the nozzle unit to a hub of the fan so that discharge openings of nozzles in the nozzle unit are oriented towards front blades of the core engine in a flow direction of the power plant;

rotating the jet power plant, thereby causing the fan hub to rotate; and pressurizing the nozzle unit with the cleaning medium and cleaning the core engine.

12. The method of claim 11, wherein the jet power plant rotates at a speed of 50 to 500 rpm.

13. The method of claim 11, wherein the jet power plant rotates at a speed of 100 to 300 rpm.

14. The method of claim 11, wherein the jet power plant rotates at a speed of 120 to 250 rpm.

15. The method of claim 11, wherein a dispersion of a liquid in a gaseous medium is used as cleaning medium.

16. The method of claim 15, wherein the liquid is an aqueous liquid.

17. The method of claim 15, wherein the gaseous medium is air.

18. The method of claim 11, wherein the cleaning medium has a temperature of 20 to 100° C.

19. The method of claim 11, wherein the pressure of the cleaning medium is 20 to 100 bar.

20. The method of claim 11, wherein the pressure of the cleaning medium is 30 to 80 bar.

21. The method of claim 11, wherein the pressure of the cleaning medium is 50 to 70 bar.

22. The method of claim 15, wherein the average droplet size of the dispersion is 50 to 500 μm.

23. The method of claim 15, wherein the liquid cleaning medium is applied at a throughput 10 to 200 l/min.

24. The method of claim 11, wherein the cleaning of the core engine is carried out over a time period of 1 to 15 min.

25. The method of claim 11, wherein the cleaning of the core engine is carried out in two cycles of about 10 seconds duration each.

26. The method of claim 11, wherein the cleaning of the core engine is carried out in two cycles of about 10 seconds duration each over a time period of about 5 minutes using in total about 12 liters of cleaning medium.

27. A method of cleaning a gas turbine engine, said engine including an engine inlet portion having a fan hub and an array of fan blades connected to and extending radially outward from said fan hub, the method comprising:

providing a mobile harness assembly;

positioning and securing the harness assembly directly onto the fan hub;

cranking the gas turbine engine, thereby causing the fan hub to rotate;

supplying washing fluid to the harness assembly; and injecting the washing fluid between fan blades and directly into the gas turbine engine core as the fan hub rotates, wherein the mobile harness assembly comprises:

a coupling device for connecting one or more fluid supply lines to one or more fluid delivery lines, said coupling device comprising a first portion configured for rotating with the fan hub about the hub's central axis as the engine is cranked and a second portion configured to remain static;

one or more fluid delivery lines removably attached at one end to the coupling device's first portion and positioned for delivering washing fluid directly into the gas turbine engine core, said fluid delivery lines rotating with the fan hub about the hub's central axis as the engine is cranked;

one or more fluid supply lines removably attached at a first end to the coupling device's second portion for supplying washing fluid to the harness assembly, said fluid supply lines remaining in a static position relative to the rotating fluid delivery lines;

one or more harness rings disposed amongst and attached to the one or more fluid delivery lines for spacing, stabilizing, and positioning the fluid delivery lines relative to the fan blades; and a connector for removably attaching the harness assembly directly onto the fan hub.

28. The method of claim 27, further comprising positioning each of the one or more fluid delivery lines between two fan blades for injecting washing fluid downstream of said fan blades and directly into the gas turbine engine core.

29. The method of claim 27, further comprising:

providing a remote washing fluid source;

connecting the washing fluid source to the one or more fluid supply lines; and supplying washing fluid to the harness assembly through the one or more fluid supply lines.

30. The method of claim 29, further comprising heating the washing fluid prior to injecting said fluid into the gas turbine engine core.

31. The method of claim 27, wherein the harness assembly further comprises a cover removably attached to the harness assembly for enclosing at least a portion of said harness assembly.

32. The method of claim 27, wherein the connector comprises a connection ring disposed at a base of the harness assembly and attached to one or more of the fluid delivery lines, said connection ring comprising at least one of a suction, clamping, connection flange, banding, and yoke and lever device.

33. The method of claim 27, wherein the harness assembly further comprises one or more nozzles connected to a second end of the one or more fluid delivery lines for injecting washing fluid directly into the gas turbine engine core.

34. The method of claim 27, wherein the harness assembly comprises:

two fluid delivery lines removably attached to the rotating first portion of the coupling device, each fluid delivery line being positioned between two fan blades such that the nozzles attached thereto are positioned at a location that is downstream of said fan blades;

one fluid supply line removably attached to the static second portion of the coupling device; one harness ring disposed between and connected to the two fluid delivery lines, said harness ring being spaced axially downstream from the coupling device and sized to prevent the coupling device from advancing towards the fan hub; and a harness connector band disposed at a base of the harness assembly for temporarily securing the harness assembly to the fan hub until an engine washing procedure is completed.

35. The method of claim 27, wherein at least one of the harness connector and harness rings is adjustable, the method further comprising sizing the harness assembly according to the size of the fan hub.

* * * * *